252-99 AU 166 Ex
8/7/79 OR 4,163,732

United States Patent [19]

Sai et al.

[11] 4,163,732

[45] Aug. 7, 1979

[54] DETERGENT COMPOSITION CONTAINING WATER-INSOLUBLE PHOSPHORUS-CONTAINING ALUMINOSILICATE BUILDERS

[75] Inventors: Fumio Sai, Funabashi; Moriyasu Murata, Chiba, both of Japan

[73] Assignee: Kao Soap Co., Ltd., Tokyo, Japan

[21] Appl. No.: 853,245

[22] Filed: Nov. 21, 1977

[30] Foreign Application Priority Data

Dec. 6, 1976 [JP] Japan ..... 51-146727

[51] Int. Cl.[2] ..... C11D 3/36; C11D 3/08; C11D 7/36

[52] U.S. Cl. ..... 252/99; 252/109; 252/135; 252/527; 252/528; 252/529; 252/531; 252/532; 252/535; 252/536; 252/538; 252/539; 252/546; 252/547; 252/548; 252/550; 252/551; 252/554; 252/555; 252/557; 252/558; 252/174.14

[58] Field of Search ..... 252/89, 109, 131, 135, 252/532, 535, 536, 539, 540, 547, 548, 538, 550, 551, 554, 555, 557, 558, 99

[56] References Cited

U.S. PATENT DOCUMENTS

| | | | |
|---|---|---|---|
| 1,419,625 | 6/1922 | Guernsey | 252/135 |
| 2,431,946 | 12/1947 | Lurie | 252/135 |
| 3,985,669 | 10/1976 | Krummel et al. | 252/116 |
| 4,000,094 | 12/1976 | Fleming et al. | 252/557 |
| 4,019,999 | 4/1977 | Ohren et al. | 252/140 |
| 4,040,972 | 8/1977 | Roebke et al. | 252/179 |
| 4,071,377 | 1/1978 | Schwuger et al. | 134/29 |

OTHER PUBLICATIONS

D. W. Breck, *Zeolite Molecular Sieves*, Copyright, 1974, John Wiley & Sons, Inc., N.Y., pp. 322–328.

*Primary Examiner*—P. E. Willis, Jr.
*Attorney, Agent, or Firm*—Blanchard, Flynn, Thiel, Boutell & Tanis

[57] ABSTRACT

A detergent composition containing, as a builder component, a water-insoluble, phosphorus-containing alkali metal aluminosilicate having the formula $$X(M_2O)\cdot Al_2O_3\cdot Y(SiO_2)\cdot z(P_2O_5)\cdot w(H_2O)$$

wherein $$0.50 \leqq x \leqq 1.10$$

$$0.80 \leqq y \leqq 2.50$$

$$0.05 \leqq z \leqq 0.80$$

and w is zero or an optional positive number.

9 Claims, No Drawings

DETERGENT COMPOSITION CONTAINING WATER-INSOLUBLE PHOSPHORUS-CONTAINING ALUMINOSILICATE BUILDERS

BACKGROUND OF THE INVENTION

1. Field of the Invention

The present invention relates to a detergent composition containing a phosphorus-containing alkali metal (sodium or potassium) aluminosilicate as a builder.

2. Description of the Prior Art

Recently, attempts have been made to reduce the amount of sodium tripolyphosphate, which is a main detergent builder, incorporated in detergents because of the increased demand and reduced supply of sodium tripolyphosphate and because of the concern about eutrophication of lakes and rivers. Various substitutes for sodium tripolyphosphate have been developed and proposed.

Among the previously proposed substitute builders, water-insoluble aluminosilicates (called "zeolites") are now considered as being the most important. Water-insoluble aluminosilicates have been known as detergent builders for a long time, and they are disclosed in, for example, U.S. Pat. No. 1,419,625, British Pat. No. 339 355, British Pat. No. 462 591, U.S. Pat. No. 2,213,641 and British Pat. No. 522 097. These zeolites have recently been reconsidered, and various zeolite builders have been proposed in, for example, Japanese Patent Kokai No. 12381/75, Japanese Patent Kokai No. 21009/75, Japanese Patent Kokai No. 53404/75, Japanese Patent Kokai No. 37104/76 and West Germany Patent Application Laid-Open Specification No. 2 538 679. Most of these aluminosilicates are alkali metal or alkaline earth metal aluminosilicates represented by the following formula (A):

$$[x'(M'_2O \text{ or } M''O).Al_2O_3.y'(SiO_2).w'(H_2O)] \quad (A)$$

wherein M' stands for an alkali metal, M'' stands for an alkaline earth metal, and x',y' and w' are numbers showing the mole numbers of the respective components. x' and y' generally satisfy the following requirements:

$$0.7 \leqq x' \leqq 1.5, \text{ and}$$

$$0.8 \leqq y' \leqq 6,$$

although these values are sometimes different in various proposals. w' is an optional positive number.

Specific examples of the previously proposed zeolite builders of this type include Molecular Sieve 3A ($(Na_2O,K_2O).Al_2O_3.2.00(SiO_2).4.5(H_2O)$), Molecular Sieve 4A ($(Na_2O).Al_2O_3.2.00(SiO_2).4.5(H_2O)$) and Molecular Sieve 13X ($(Na_2O).Al_2O_3.2.46(SiO_2).6.4(H_2O)$).

We have found that these previously proposed aluminosilicates, represented by the formula (A), have a relatively high calcium ion exchange capacity, but they are defective in that the magnesium ion exchange capacity is relatively low. As is well-known in the art, washing water (ordinary tap water) contains a large quantity of magnesium ions together with calcium ions, and these ions inhibit the washing action. As a result of our various investigations, it was found that in order to be suitable for effective use as a builder substitute for sodium tripolyphosphate, an aluminosilicate should have not only an appropriate calcium ion exchange capacity, but also an appropriate magnesium ion exchange capacity.

SUMMARY OF THE INVENTION

We have discovered that the above-mentioned defect of aluminosilicates represented by the general formula (A) can be eliminated, or at least reduced, by employing a phosphorus-containing alkali metal aluminosilicate having the formula (I) given below, as a detergent builder.

More specifically, in accordance with the present invention, there is provided a detergent composition containing 3 to 95% by weight of a water-insoluble, phosphorus-containing alkali metal aluminosilicate having the following formula (I):

$$[x(M_2O).Al_2O_3.y(SiO_2).z(P_2O_5).w(H_2O)] \quad (I)$$

and wherein M is an alkali metal selected from the group consisting of sodium and potassium, x, y, z and w are the mole numbers of the respective components, wherein x, y and z satisfy the following relationships:

$$0.50 \leqq x \leqq 1.10,$$

$$0.20 \leqq y \leqq 2.50, \text{ and}$$

$$0.05 \leqq z \leqq 0.80, \text{ preferably } 0.10 \leqq z \leqq 0.55,$$

and w being an optional positive number.

The phosphorus-containing alkali metal aluminosilicates having the formula (I) can be crystalline or amorphous.

Detergent builders are required to have a calcium ion exchange capacity and a magnesium ion exchange capacity of at least 100 mg, calculated as calcium carbonate, preferably at least 150 mg, per g of the builder. The phosphorus-containing alkali metal aluminosilicate of the present invention having the formula (I) fully meets this requirement. When the polyvalent metal ion exchange capacity of the phosphorus-containing alkali aluminosilicate of the present invention (formula I) is compared with that of an aluminosilicate represented by the formula (A), there is no substantial difference between them with respect to their calcium ion exchange capacity, but the aluminosilicate of the present invention (formula I) is much superior to the known aluminosilicate (formula A) with respect to their magnesium ion exchange capacity. It is believed that the phosphorus-containing alkali metal aluminosilicate of the present invention (formula I) has a structure in which a part of the ($SiO_2$) in the aluminosilicate of the formula (A) is replaced by ($PO_4$), and that the presence of this ($PO_4$) group has some influence on the properties of the surfaces of the solids and the polyvalent metal ion exchange capacities desirable for the builder are manifested. However, the exact mechanism that provides this improved effect is not known.

The builder action of the phosphorus-containing alkali metal aluminosilicate (formula I) cannot be defined by only the polyvalent metal ion exchange capacity, but it is substantially defined by the values x, y, z and w in the formula (I). In the formula (I), w indicates the mole number of water of crystallization or adsorbed water, and it may optionally be changed depending on the synthesis conditions or on the conditions of the post treatment conducted after synthesis. In general, w is up to 20.

For example, the phosphorus-containing alkali metal aluminosilicate (formula I) can be obtained by simultaneously adding an aqueous solution of an alkali metal siicate and an aqueous solution of an alkali metal phosphate to an aqueous solution of aluminum sulfate, agitating the mixture, adding sodium hydroxide to the mixture and continuing the agitation at a temperature of 20° to 120° C. The properties of the product are varied depending on the reaction temperature and reaction time. When the reaction is carried out at a low temperature for a short time, an amorphous product is obtained, and when the reaction is carried out at a high temperature for a long time, a crystalline product is obtained. Practical reaction conditions for obtaining an amorphous product are a reaction temperature of 90° to 100° C. and a reaction time of about 1.5 hours. Practical reaction conditions for obtaining a crystalline product are a reaction temperature of about 120° C. and a reaction time of about 24 hours. An amorphous product that can easily be obtained is advantageous from an industrial viewpoint. A process for the synthesis of crystalline phosphorus-containing alkali metal aluminosilicates is disclosed in detail in, for example, Japanese Patent Publication No. 29579/70 and E. M. Flanigen and R. W. Grose, Advances in Chemistry Series, 101, 76 (1971), American Chemical Soc., Washington, D.C.

The phosphorus-containing alkali metal aluminosilicate (formula I) is incorporated into the detergent composition of the present invention in an amount of from 3 to 95% by weight, preferably from 8 to 50% by weight, especially preferably from 14 to 40% by weight.

The detergent composition of the present invention also contains from 1 to 50% by weight, preferably from 5 to 40% by weight, especially preferably from 10 to 30% by weight, of at least one member selected from various anionic surface active agents, nonionic surface active agents and amphoteric surface active agents described hereinafter. In the case of the anionic surface active agent, as the counter ion, there can be mentioned, for example, ions of alkali metals such as sodium and potassium, ions of alkaline earth metals such as calcium and magnesium, ammonium ions, and salts of alkanolamines having 1 to 3 alkanol groups containing 2 or 3 carbon atoms, such as monoethanolamine, diethanolamine, triethanolamine and triisopropanolamine.

The surface active agents that can be used in the present invention are as follows:

(1) Linear and branched alkylbenzenesulfonic acid salts, containing an alkyl group having 10 to 16 carbon atoms on the average.

(2) Alkyl and alkenyl ethoxy sulfuric acid salts containing a linear or branched alkyl or alkenyl group having an average carbon number of 10 to 20 and having from 0.5 to 8 moles, on the average, of added ethylene oxide units in the molecule.

(3) Salts of alkyl and alkenyl sulfuric acids containing an alkyl or alkenyl group having an average carbon number of 10 to 20.

(4) Olefin sulfonic acid salts having 10 to 20 carbon atoms in the molecule on the average.

(5) Alkane sulfonic acid salts having 10 to 20 carbon atoms in the molecule on the average.

(6) Saturated and unsaturated fatty acid salts having 10 to 20 carbon atoms in the molecule on the average.

(7) Alkyl and alkenyl ethoxy carboxylic acid salts containing an alkyl or alkenyl group having an average carbon number of 10 to 20 and having from 0.5 to 8 moles on the average of added ethylene oxide units in the molecule.

(8) Polyoxyethylene alkyl and alkenyl ethers containing an alkyl or alkenyl group having an average carbon number of 10 to 20 and having from 3 to 12 moles of added ethylene oxide units on the average.

(9) Polyoxyethylene alkyl phenyl ethers having an alkyl group having 8 to 12 carbon atoms and having from 3 to 12 moles of added ethylene oxide units on the average.

(10) Alkylamine oxides having the formula:

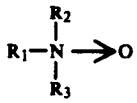

wherein $R_1$ is alkyl or alkenyl having 10 to 20 carbon atoms, and $R_2$ and $R_3$, which can be the same or different, are alkyl having 1 to 3 carbon atoms.

(11) Higher fatty acid alkanolamines and alkylene oxide adducts thereof having the formula:

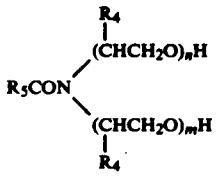

wherein $R_4$ is H or $CH_3$, $R_5$ is alkyl or alkenyl having 10 to 20 carbon atoms, n is an integer of 1 to 3 and m is an integer of 0 to 3.

(12) Amphoteric surface active agents having the formula:

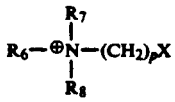

wherein $R_6$ is alkyl or alkenyl having 10 to 20 carbon atoms, $R_7$ and $R_8$ is alkyl having 1 to 4 carbon atoms, p is an integer of 1 to 3, and X is $-COO^{\ominus}$ or $-SO_3^{\ominus}$.

(13) α-Sulfo-fatty acid salts and esters having the formula:

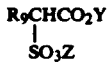

wherein Y is alkyl having 1 to 3 carbon atoms or a counter ion selected from the counter ions mentioned above with respect to the anionic surface active agent, Z is a counter ion selected from the counter ions mentioned above with respect to the anionic surface active agent, and $R_9$ is alkyl or alkenyl having 10 to 20 carbon atoms.

In addition to the phosphorus-containing alkali metal, aluminosilicate of the formula (I) employed as the polyvalent metal ion sequestering agent, the composition of the present invention may contain 0 to 50% by weight, preferably 5 to 40% by weight, of at least one alkali metal salt as a builder component. As such alkali metal salt, there can be mentioned, for example, condensed phosphates such as tripolyphosphates, pyrophosphates and metaphosphates, amino-polyacetates such as nitrilotriacetates, ethylenediamine tetraacetates and diethylenetriamine pentaacetates, hydroxycarboxylates such as citrates, malates and gluconates, and polymeric electrolytes such as polyacrylates and salts of alkali-hydrolyzed vinyl acetate-maleic anhydride copolymers.

The detergent composition may further comprise 1 to 50% by weight, preferably 5 to 30% by weight, of at least one alkaline agent or inorganic electrolyte selected from alkali metal silicates, alkali metal carbonates and alkali metal sulfates.

Still further, the detergent composition of the present invention may comprise 0.1 to 5% by weight of at least one anti-soil-redeposition agent selected from polyethylene glycol, polyvinyl alcohol, polyvinyl pyrrolidone and carboxymethyl cellulose.

Still further, a bleaching agent such as sodium percarbonate, sodium perborate or sodium persulfate, a whitening agent such as a commercially available fluorescent dye, and a perfume, an enzyme and other additives may be added to the composition of the present invention, according to need.

The composition of the present invention is recommended as a detergent for clothes, furniture and flooring materials. It is applied in the form of a solid detergent or a liquid detergent according to the intended use. As the solid detergent, there can be mentioned, for example, spray-dried powders, mixed powders, granules, tablets and toilet soap bars. Preparation of stable dispersions of the composition of the present invention involves various technical difficulties. Therefore, in the case of a liquid detergent, it is preferred that the composition of the present invention be used in the two-pack form wherein all of the water-soluble components of the detergent composition are in one package in aqueous solution form and the formula I ingredient is provided as a second package.

When the phosphorus-containing aluminosilicate (formula I) of the present invention is incorporated in detergent compositions in the form of spray-dried powders, mixed powders and granules, there is attained the further effect of a remarkable improvement in the free-flowing (anti-caking or non-agglomerating) property of these powders and granules in addition to the effect of improving the detergency of the composition.

When the phosphorus-containing aluminosilicate (formula I) of the present invention is incorporated into soap bars or synthetic solid surface active agent detergents (syndet bars), deformation of the bars is effectively prevented and the beautiful original form thereof is retained until they are used up.

The present invention will now be further described in detail by reference to the following illustrative Examples that do not limit the scope of the invention.

EXAMPLE 1

(1) Synthesis of Phosphorus-Containing Aluminosilicate (formula I)

The following two aqueous solutions A and B were prepared:

(A) A solution of 16.3 g of aluminum sulfate ($Al_2(SO_4)_3.16\text{-}18H_2O$) in 75 ml of water.

(B) A solution of 12.2 g of sodium silicate ($Na_2SiO_3.9H_2O$) and 9.5 g of sodium phosphate ($Na_3PO_4.12H_2O$) in 50 ml of water.

The aqueous solution B was added to the aqueous solution A, and the mixture was agitated at room temperature. Then, a solution of 2.5 g of sodium hydroxide in 50 ml of deionized water was added to the mixture. The reaction was effected, under agitation at a constant temperature of 95° C. The reaction products were sampled after 1.5 hours and 150 hours from the start of the reaction. The crude products were washed with deionized water and dried at 105° C.

By X-ray diffraction measurement, it was found that the product obtained by 1.5 hours' reaction time was an amorphous solid and the product obtained by 150 hours' reaction time was crystalline. From the results of chemical analysis, it was confirmed that the composition of the amorphous product (P-1) had a composition of $0.63(Na_2O).(Al_2O_3).1.92(SiO_2).0.10(P_2O_5).6H_2O$ and the crystalline product (P-2) had a composition of $0.65(Na_2O).(Al_2O_3).2.00(SiO_2).0.22(P_2O_5).4H_2O$.

(2) Measurement of the Polyvalent Metal Ion Sequestering Capacity (hereinafter referred to as "SC")

To 200 ml of an aqueous solution of calcium chloride or magnesium chloride (containing 500 ppm, calculated as calcium carbonate, in 200 cc of water) there was added 0.2 g of the sample formula I compound, and the mixture was agitated at room temperature for 15 minutes while adjusting the pH to 10 by addition of hydrochloric acid or sodium hydroxide. Then, the insoluble substances were removed by filtration. The hardness ($H_1$) before addition of the sample and the hardness ($H_2$) of the filtrate were determined by titration using an aqueous solution of sodium ethylene-diamine tetraacetate (EDTA). The polyvalent metal ion-sequestrating capacity (SC) was calculated according to the following formula:

$$SC = \frac{H_1 - H_2}{\text{weight (g) of sample in 1 l}}$$

(3) Washing Test

(3-1) Preparation of Artificially Soiled Cloth

Cotton cloths having a size of 10 cm×10 cm were soiled with an oily composition having the following recipe and a minute amount of carbon black:

Cotton seed oil—60%
Cholesterol—10%
Oleic acid—10%
Palmitic acid—10%
Liquid and solid paraffins—10%

(3-2) Calculation of Washing Ratio

The reflectances of the original cloth and the soiled cloth before and after the washing treatment were measured by an automatic recording colorimeter (manufactured by Shimazu Seisakusho), and the washing ratio (D, %) was calculated according to the following formula:

$$D=(L_2-L_1)/(L_0-L_1)\times 100$$

wherein $L_0$ stands for the reflectance of the original cloth, $L_1$ stands for the reflectance of the soiled cloth before washing, and $L_2$ stands for the reflectance of the soiled cloth after washing.

(3-3) Washing Method

Washing was carried out under the following conditions by using a Terg-O-Meter:

Bath ratio: 1/60
Washing time: 10 minutes

Rinsing: 5 minutes by service water
Hardness of water: 4° DH ($Ca^{2+}M_g^{2+}$ molar ratio=3/1)
Detergent concentration: 0.2% by weight (4) Composition of Detergent Sodium linear-dodecylbenzenesulfonate—20% by weight
Builder—0–40% by weight
Sodium silicate—5% by weight
Sodium carbonate—3% by weight
Fluorescent dye—0.3% by weight
Water—10% by weight
Sodium sulfate—balance (5) Results (5-1) Polyvalent Metal Ion-Sequestering Capacity (SC)

The calcium ion- and magnesium ion-sequestering capacities of the products P-1 and P-2 of the present invention are shown in Table 1. The calcium ion- and magnesium ion-sequestering capacities of the products P-1 and P-2 were found to be higher than those of the previously proposed products. Further, it was found that there was no substantial difference between the polyvalent sequestering capacities of the products P-1 and P-2 of the present invention.

Table 1

| Sample No. | Builder | $Ca^{++}$ (calculated as mg $CaCO_3$) per g of builder (calculated on an anhydrous basis) | $Mg^{++}$ (calculated as mg $CaCO_3$) per g of builder (calculated on an anhydrous basis) |
|---|---|---|---|
| 1 (control) | Sodium Tripolyphosphate (STPP) | 303 | — |
| 2 (control) | $(Na_2O,K_2O)(Al_2O_3) . 2.00(SiO_2) . 4.5H_2O$ | 253 | — |
| 3 (control) | $(Na_2O) . (Al_2O_3) . 2.00(SiO_2) . 4.5H_2O$ | 280 | 75 |
| 4 (control) | $(Na_2O) . (Al_2O_3) . 2.46(SiO_2) . 6.4H_2O$ | 221 | 170 |
| 5 (invention) | P-1 | 285 | 173 |
| 6 (invention) | P-2 | 287 | 178 |

(5-2) Washing Power

In the detergent composition described in (4) above, the amount incorporated of the builder was changed in the various tests and the washing power (D) was measured. The results shown in Table 2 were obtained. It will readily be understood that the products P-1 and P-2 of the present invention were superior in comparison with the previously proposed products. When the products of the present invention were used in combination with sodium tripolyphosphate, the washing power was further improved.

Table 2

| Sample No. | Builder | Amount (% by weight) | D (%) |
|---|---|---|---|
| 7 | not added | — | 40 |
| 8 | STPP (sodium tripolyphosphate) | 10 | 51 |
| 9 | " | 20 | 62 |
| 10 | " | 40 | 70 |
| 11 | $(Na_2O,K_2O) . (Al_2O_3) . 2.00(SiO_2) . 4.5H_2O$ | 20 | 55 |
| 12 | $(Na_2O) . (Al_2O_3) . 2.46(SiO_2) . 6.4H_2O$ | 20 | 53 |
| 13 | $(Na_2O) . (Al_2O_3) . (Al_2O_3) . 2.00(SiO_2) . 4.5H_2O$ | 10 | 45 |
| 14 | " | 20 | 57 |
| 15 | " | 40 | 65 |
| 16 | STPP/$(Na_2O) . (Al_2O_3) . 2.00(SiO_2) . 4.5H_2O$ | 10/10 | 58 |
| 17 | " | 20/20 | 68 |
| 18* | P-1 | 10 | 50 |
| 19* | " | 20 | 63 |
| 20* | " | 40 | 72 |
| 21* | P-2 | 10 | 51 |
| 22* | " | 20 | 62 |
| 23* | " | 40 | 73 |
| 24* | STPP/P-1 | 10/10 | 64 |
| 25* | " | 20/20 | 73 |
| 26* | STPP/P-2 | 10/10 | 63 |
| 27* | " | 20/20 | 75 |

*product of the present invention

EXAMPLE 2

According to the same test method as described in Example 1, the builder effect of the phosphorus-containing aluminosilicate in a detergent composition having the following recipe was examined. The results shown in Table 3 were obtained.

| Detergent Composition: | |
|---|---|
| Sodium linear-dodecylbenzenesulfonate | 15% by weight |
| Sodium alkyl sulfate (from oxoalcohol having average carbon number of 14.5) | 5% by weight |
| Sodium alkylethoxy sulfate (from adduct of 1.5 moles of ethylene oxide to oxo- | 5% by weight |

-continued

| Detergent Composition: | |
|---|---|
| alcohol having average carbon number of 12.8) | |
| Builder | shown in Table 3 |
| Sodium silicate | 3% by weight |
| Sodium percarbonate | 20% by weight |
| Fluorescent whitening agent (Mike-White manufactured by Mitsui Toatsu) | 0.2% by weight |
| Fluorescent whitening agent (Cinopal CBS manufactured by Ciba-Geigy) | 0.2% by weight |
| Polyethylene glycol (average molecular weight = 6000) | 3% by weight |
| Beef tallow soap | 1.5% by weight |
| Magnesium silicate | 0.5% by weight |
| Water | 5% by weight |
| Sodium sulfate | balance |

Table 3

| Sample No. | Builder | Amount (%) | D (%) |
|---|---|---|---|
| 28 | STPP | 40 | 88 |
| 29 | $(Na_2O,K_2O) . (Al_2O_3) . 2.00)SiO_2) . 4.5H_2O$ | 40 | 72 |
| 30 | $STPP/(Na_2O,K_2O) . (Al_2O_3) . 2.00(SiO_2) . 4.5H_2O$ | 20/20 | 85 |
| 31* | P-3 | 40 | 87 |
| 32* | STPP/P-3 | 20/20 | 92 |
| 33* | P-4 | 40 | 89 |
| 34* | STPP/P-4 | 20/20 | 93 |
| 35* | P-5 | 40 | 88 |
| 36* | STPP/P-5 | 20/20 | 92 |

*product of the present invention
P-3: $0.60(Na_2O) . (Al_2O_3) . 2.50(SiO_2) . 0.10(P_2O_5) . 4H_2O$, amorphous
P-4: $0.58(Na_2O) . (Al_2O_3) . 1.00(SiO_2) . 0.52(P_2O_5) . 3H_2O$, crystalline
P-5: $0.54(K_2O) . (Al_2O_3) . 1.50(SiO_2) . 0.40(P_2O_5) . 4H_2O$, crystalline

EXAMPLE 3

The builder effect of the phosphorus-containing aluminosilicate in the following detergent composition was examined under the same conditions as in Example 1 except that the washing temperature and the water hardness were changed to 80° C. and 15° DH, respectively.

| Detergent Composition: | |
|---|---|
| Polyoxyethylene stearyl ether (Emalgen manufactured by Kao Soap) | 2% by weight |
| Beef tallow soap | 3% by weight |
| Sodium linear-dodecylbenzene-sulfonate | 6% by weight |
| Sodium silicate | 3% by weight |
| Sodium carbonate | 2% by weight |
| Carboxymethyl cellulose | 1% by weight |
| Sodium perborate | 15% by weight |
| Builder | shown in Table 4 |
| Water | 15% by weight |
| Sodium sulfate | balance |

Table 4

| Sample No. | Builder | Amount (%) | D (%) |
|---|---|---|---|
| 37 | STPP | 40 | 92 |
| 38 | $(Na_2O) . (Al_2O_3) . 2.46 (SiO_2) . 6.4H_2O$ | 40 | 83 |
| 39 | $STPP/(Na_2O) . (Al_2O_3) . 2.46 (SiO_2) . 6.4H_2O$ | 20/20 | 88 |
| 40 | P-6 | 40 | 91 |
| 41* | STPP/P-6 | 20/20 | 93 |
| 42* | P-7 | 40 | 92 |
| 43* | STPP/P-7 | 20/20 | 92 |

*product of the present invention
P-6: $0.56 (Na_2O . (Al_2O_3) . 0.81 (SiO_2) . 0.36 (P_2O_5) . 3H_2O$, amorphous
P-7: $1.00 (Na_2O) . (Al_2O_3) . 1.70 (SiO_2) . 0.24 (P_2O_5) . 3H_2O$, crystalline

EXAMPLE 4

In the recipe shown in Example 2, 15% by weight of P-1 prepared in Example 1 and 15% by weight of STPP were used as the builder and the sodium alkylethoxy sulfate was replaced by α-sulfo-(beef tallow)-fatty acid methyl ester. The washing power of the detergent was superior to the washing power of a commercially available powdery detergent comprising 30% by weight of STPP (the washing power was determined according to the method described in Example 1).

EXAMPLE 5

In the recipe shown in Example 2, 15% by weight of P-2 prepared in Example 1 and 15% by weight of STPP were used as the builder and the sodium alkylethoxy sulfate was replaced by sodium alkanesulfonate having an average alkyl chain length of 15.3 (Hastapur 60 manufactured by Hochst AG., West Germany). The washing power of the detergent was excellent in comparison with the washing power of a commercially available powdery detergent comprising 30% by weight of STPP (the washing power was determined according to the method described in Example 1).

EXAMPLE 6

In the recipe shown in Example 2, 15% by weight of P-3 prepared in Example 2 and 15% by weight of STPP were used as the builder and the sodium alkylethoxy sulfate was replaced by sodium α-olefin-sulfonate (sodium sulfonate, Diarene 168 manufactured by Mitsubishi Kasei). The washing power of the detergent was superior to the washing power of a commercially available powdery detergent comprising 30% by weight of STPP (the washing power was determined according to the method described in Example 1).

The embodiments of the invention in which an exclusive property or privilege is claimed are defined as follows:

1. A detergent composition consisting essentially of 3 to 95% by weight of a water-insoluble, phosphorus-containing alkali metal aluminosilicate having the formula (I):

$$x(M_2O)\cdot Al_2O_3\cdot y(SiO_2)\cdot z(P_2O_5)\cdot w(H_2O) \quad (I)$$

wherein M is an alkali metal selected from the group consisting of sodium and potassium, x, y, z and w are the mole numbers of the respective components, wherein x, y and z satisfy the following relationships:

$$0.50 \leqq x \leqq 1.10,$$

$$0.80 \leqq y \leqq 2.50, \text{ and}$$

$$0.05 \leqq z \leqq 0.80,$$

and w is zero or an optional positive number, from 1 to 50% by weight of water-soluble organic surfactant selected from the group consisting of anionic, nonionic and amphoteric water-soluble organic surfactants, and mixtures thereof;

from zero to 50% by weight of water-soluble alkali metal builder salt and mixtures thereof, and from 1 to 50% by weight of water-soluble substance selected from the group consisting of alkali metal silicates, alkali metal carbonates, alkali metal sulphates and mixtures thereof.

2. A detergent composition as set forth in claim 1 containing from 8 to 50% by weight of said water-insoluble, phosphorus-containing alkali metal aluminosilicate.

3. A detergent composition as set forth in claim 1 wherein z satisfies the following relationship:

$$0.10 \leqq z \leqq 0.55.$$

4. A detergent composition according to claim 1, in which said water-soluble organic surfactant is selected from the group consisting of linear and branched alkylbenzenesulfonic acid salts containing an alkyl group having 10 to 16 carbon atoms on the average, alkyl and alkenyl ethoxy sulfuric acid salts containing a linear or branched alkyl or alkenyl group having an average carbon number of 10 to 20 and having from 0.5 to 8 moles, on the average, of added ethylene oxide units in the molecule, salts of alkyl and alkenyl sulfuric acids containing an alkyl or alkenyl group having an average carbon number of 10 to 20, olefin sulfonic acid salts having 10 to 20 carbon atoms in the molecule on the average, alkane sulfonic acid salts having 10 to 20 carbon atoms in the molecule on the average, saturated and unsaturated fatty acid salts having 10 to 20 carbon atoms in the molecule on the average, alkyl and alkenyl ethoxy carboxylic acid salts containing an alkyl or alkenyl group having an average carbon number of 10 to 20 and having from 0.5 to 8 moles on the average of added ethylene oxide units in the molecule, wherein the counter ion of the foregoing named salts is selected from the group consisting of sodium, potassium, calcium, magnesium, ammonium and alkanolamine having 1 to 3 alkanol groups containing 2 or 3 carbon atoms, polyoxyethylene alkyl and alkenyl ethers containing an alkyl or alkenyl group having an average carbon number of 10 to 20 and having from 3 to 12 moles of added ethylene oxide units on the average, polyoxyethylene alkyl phenyl ethers having an alkyl group having 8 to 12 carbon atoms and having from 3 to 12 moles of added ethylene oxide units on the average, alkylamine oxides having the formula:

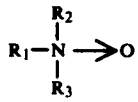

wherein $R_1$ is alkyl or alkenyl having 10 to 20 carbon atoms, and $R_2$ and $R_3$, which can be the same or different, are alkyl having 1 to 3 carbon atoms, higher fatty acid alkanolamines and alkylene oxide adducts thereof having the formula:

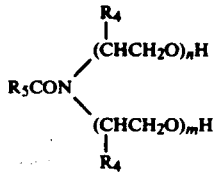

wherein $R_4$ is H or $CH_3$, $R_5$ is alkyl or alkenyl having 10 to 20 carbon atoms, n is an integer of 1 to 3 and m is an integer of 0 to 3, amphoteric surface active agents having the formula:

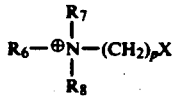

wherein $R_6$ is alkyl or alkenyl having 10 to 20 carbon atoms, $R_7$ and $R_8$ is alkyl having 1 to 4 carbon atoms, p is an integer of 1 to 3, and X is $-COO^{\ominus}$ or $-SO_3^{\ominus}$, α-sulfo fatty acid salts and esters having the formula:

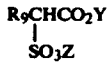

wherein Y is alkyl having 1 to 3 carbon atoms or said counter ion, z is said counter ion, and $R_9$ is alkyl or alkenyl having 10 to 20 carbon atoms, and mixtures thereof.

5. A detergent composition according to claim 4, containing from 8 to 50% by weight of said water-insoluble, phosphorus-containing alkali metal aluminosilicate, from 5 to 40% by weight of said water-soluble organic surfactant and from 5 to 30% by weight of said water-soluble substance.

6. A detergent composition according to claim 5, containing from 14 to 40% by weight of said water-insoluble, phosphorus-containing alkali metal aluminosilicate and from 10 to 30% by weight of said water-soluble organic surfactant.

7. A detergent composition according to claim 6 containing an effective amount of a water-soluble peroxygen bleaching agent capable of releasing hydrogen peroxide when dissolved in water.

8. A detergent composition according to claim 6 in which the balance of the composition is essentially sodium sulfate.

9. A detergent composition according to claim 6 in which said water-soluble alkali metal builder salt is sodium tripolyphosphate and the amount thereof is from 10 to 20% by weight, said composition containing from 10 to 20% by weight of said water-insoluble, phosphorus-containing alkali metal aluminosilicate.

* * * * *